United States Patent [19]

Potter

[11] Patent Number: 5,069,245

[45] Date of Patent: Dec. 3, 1991

[54] MIXING VALVE

[75] Inventor: Terry C. Potter, Sylvania, Ohio

[73] Assignee: Tolco Corporation, Toledo, Ohio

[21] Appl. No.: 529,532

[22] Filed: May 29, 1990

Related U.S. Application Data

[63] Continuation-in-part of Ser. No. 467,639, Jan. 19, 1990, abandoned.

[51] Int. Cl.[5] ..... B01F 5/04

[52] U.S. Cl. ..... 137/218; 137/893; 137/895

[58] Field of Search ..... 137/218, 888, 892-895

[56] References Cited

U.S. PATENT DOCUMENTS

| | | | |
|---|---|---|---|
| 3,112,884 | 12/1963 | Gilmour | 137/893 |
| 3,658,091 | 4/1972 | Buzzi | 137/893 X |
| 4,469,137 | 9/1984 | Cleland | 137/893 |

*Primary Examiner*—Robert G. Nilson

*Attorney, Agent, or Firm*—Emch, Schaffer, Schaub & Porcello Co.

[57] ABSTRACT

A mixing valve is provided for mixing together two liquids in varying proportions and has the capability of being joined in series to other mixing valves, each of which, other than the first of the series, receives water from its adjacent valve.

33 Claims, 8 Drawing Sheets

MIXING VALVE

CROSS REFERENCE TO RELATED APPLICATION

This is a continuation-in-part of application Ser. No. 07/467,639, filed Jan. 19, 1990, now abandoned.

BACKGROUND OF THE INVENTION

Valves and mixing devices for combining two different liquids in a specific proportion have long been known in the prior art. Thus, it is frequently desirable to add some type of liquid concentrate to water or other liquid to provide a mixture or solution having specific properties and proportions.

Examples of prior art liquid mixing devices include U.S. Pat. Nos. 3,791,410; 4,469,137; 4,285,367; 4,761,077 and 4,549,813.

U.S. Pat. No. 3,791,410 discloses a liquid mixing device in which an outer container has an inlet for introducing a first liquid under pressure and an inner container integrally formed therewith and having an inlet in a common wall for admitting a second liquid to become mixed with the first liquid. A regulatable valve is provided for regulating the amount of second liquid introduced to the first liquid.

U.S. Pat. No. 4,469,137 is directed to a liquid metering and mixing aspirator for mixing liquid soft drink concentrate with water. It includes an elongate aspirator chamber which communicates with a water supply passage on the one hand and with a concentrate metering valve on the other hand. The two liquids are transmitted from the aspirator chamber to a mixing tube which includes a water jet deflecting means.

U.S. Pat. No. 4,285,367 is directed to a mixing device to effect an intense and rapid mixing of two fluids which is comprised of a venturi tube connected to the first fluid inlet and a feed member disposed around the venturi tube through which the second fluid can flow.

U.S. Pat. No. 4,761,077 is directed to a mixing apparatus including a cylindrical mixing chamber having a fluid inlet at one end, a frustoconical tubular end piece connected to the other end and flaring outwardly by progressively increasing in diameter in an outward direction to form a fluid outlet. The mixing chamber has a plurality of row of openings inclined inwardly toward the fluid outlet. An outer jacket surrounds the liquid mixing chamber to form a liquid receiving chamber.

U.S. Pat. No. 4,549,813 is directed to a mixing apparatus for a plurality of liquids and includes an elongated passage for carrying one of the liquids to a mixing chamber. A check valve is positioned in the passage. A second liquid is introduced into the mixing compartment by way of an inlet chamber which establishes an annular flow in a direction normal to the flow of the laterally exiting streams.

SUMMARY OF THE INVENTION

The mixing valve of the present invention is economically formed with a few parts, is adjustable to vary the concentration of the added liquid relative to water or other primary liquid and, if desired, may be combined in series with a number of other valves for mixing a number of different types of concentrates with a single source of water or other primary liquid to provide a number of different types of mixtures or solutions.

Accordingly, it is an object of the present invention to provide an economical mixing valve for adding specific portions of a second liquid to a first liquid and for mixing such liquids together.

It is a further object of the present invention to provide a liquid proportioning and mixing device in which the proportion of the second liquid relative to the first liquid may be varied through a simple valve adjustment pregraduated before the mixing or during the mixing in process.

It is yet another object of the present invention to provide a mixing valve which may be fastened in series to one of a number of other valves to provide a plurality of separate liquid mixtures or solutions using a common primarily liquid source.

IN THE DRAWINGS

DESCRIPTION OF THE PREFERRED EMBODIMENT

Figure 1:
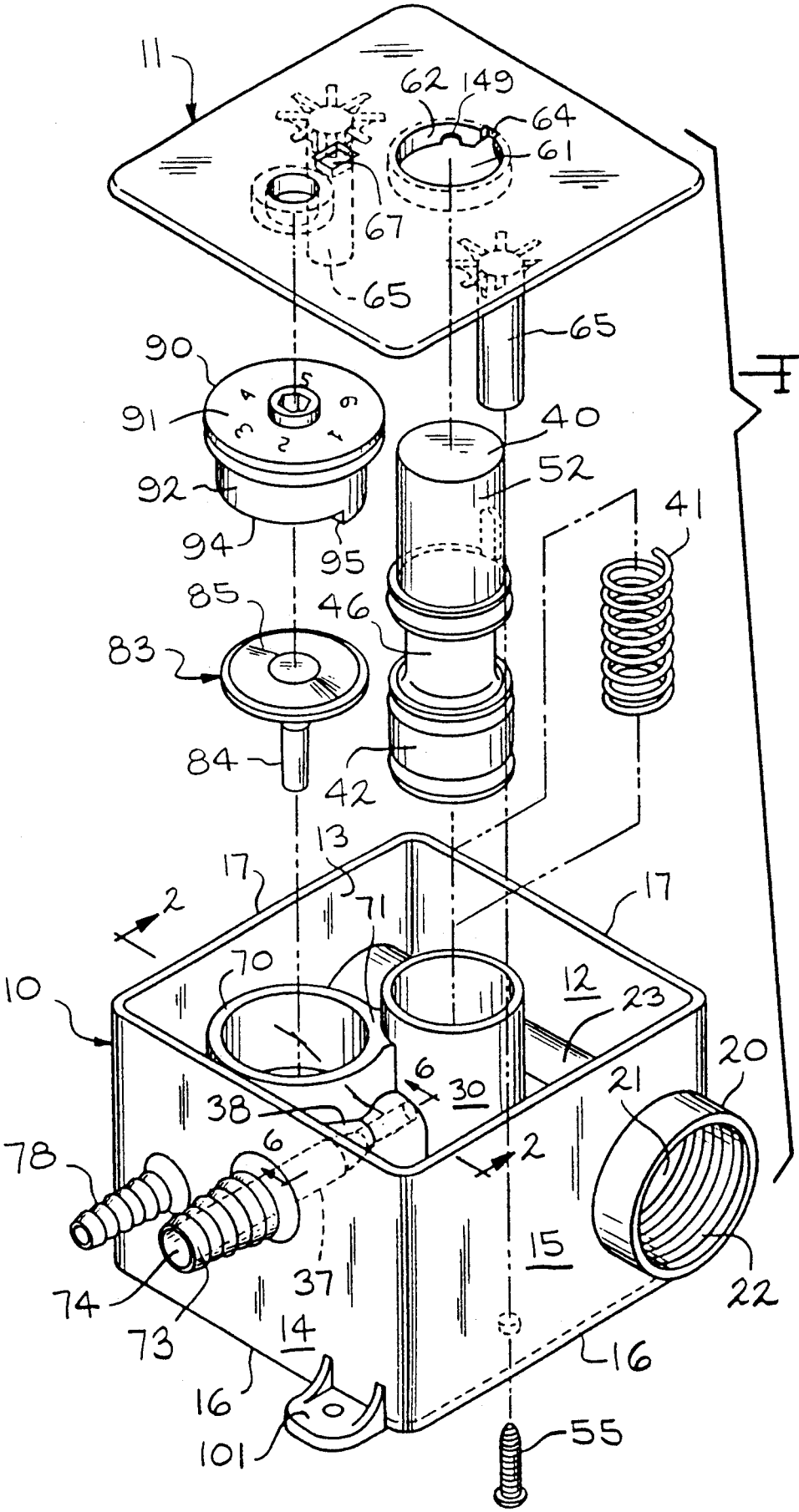
FIG. 1 is an exploded perspective view showing the mixing valve of my new invention.
Figure 2:
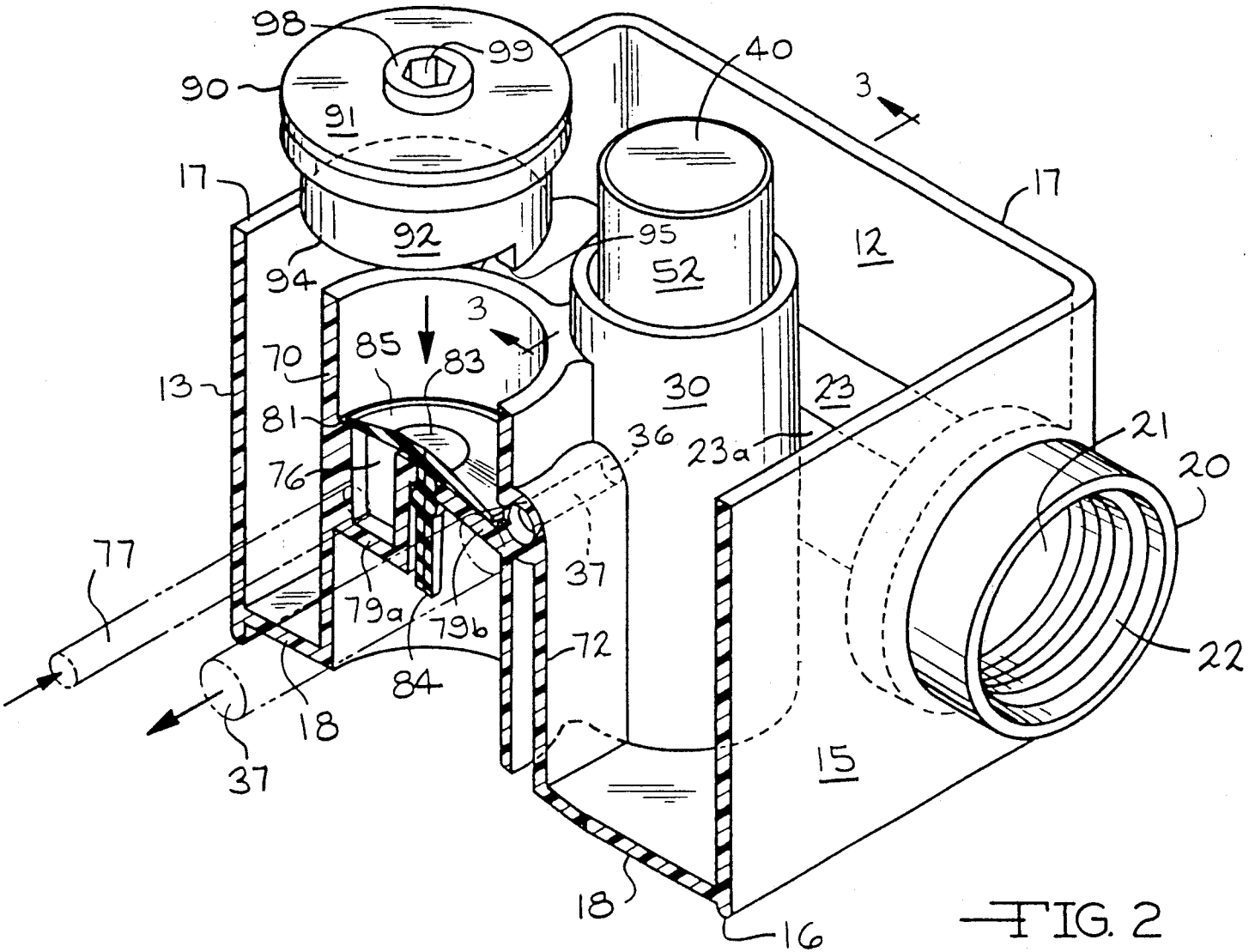
FIG. 2 is a perspective view, partially in section, taken through line 2—2 of FIG. 1.

Referring now to FIGS. 1 and 2, there is provided a housing 10 and a lid 11 adapted to be affixed thereto. The housing includes side wall members 12, 13, 14 and 15 which are joined together to form a body having a substantially rectangular configuration with rounded edges.

Each of the side wall members 12, 13, 14 and 15 extends from a lower edge 16 to an upper edge 17. Each of the lower edge 16 and the upper edge 17 defines a plane. A bottom wall 18 is joined to the respective side wall members 12, 13, 14 and 15 near the lower edge 16. It should be understood that although the terms lower edge and upper edge are used in describing the invention, this relates to only to the positioning of the valve as shown in the drawings and the valve of the present invention may be turned or oriented in any direction. Thus, the valve of the present invention may be mounted on a horizontal support or on a vertical or inclined wall or may be utilized without being mounted on any rigid supporting structure.

The housing includes a major inlet coupling 20 having an inlet opening 21 for receiving the one of the two liquids to be mixed having the greatest proportion. Typically, it will be water which is introduced into the major inlet coupling 20; however, it could be any other liquid desired for the major component of the mixture or solution. The major inlet coupling 20 is integrally formed with the wall member 15 and may be provided with interior threads 22 to which a garden hose or similar water or other liquid flow means may be connected.

Integrally formed with and extending between the walls 15 and 13 is a lateral conduit 23 having a passageway 24 (see FIGS. 3, 4 and 5) aligned with the inlet opening 21. The passageway 24 terminates at an outlet coupling 25 integrally formed with and extending from the wall 13. The outlet coupling 25 is formed with exterior threads 26 designed to mate with the interior threads 22 of the inlet coupling 20. As will be appreciated, if it is desired to utilize a plurality of valves in series, the outlet coupling 25 of one valve may be threadedly engaged to the inlet coupling 20 of an adjacent valve. If it is not desired to utilize a plurality of valves in series, the outlet coupling 25 may simply be capped. In any event, as will be appreciated, the introduction of the second liquid and mixing thereof with the first liquid takes place irrespective of whether a portion of the first liquid exits through the outlet coupling 25.

The lateral conduit 23 desirably has a web 27 extending from one side and integrally formed with the wall portion 12 to provide additional support for such conduit 23. As can be seen particularly in FIG. 3 and 5, the portion of the conduit 23 adjacent the inlet coupling 20 has a semicircular cross-sectional configuration while the portion of the conduit 23 adjacent the outlet coupling 25 has a circular configuration. As a result, the lateral conduit 23 has a flat-walled section 23*a* in the area adjacent the inlet coupling 20.

Figure 13:
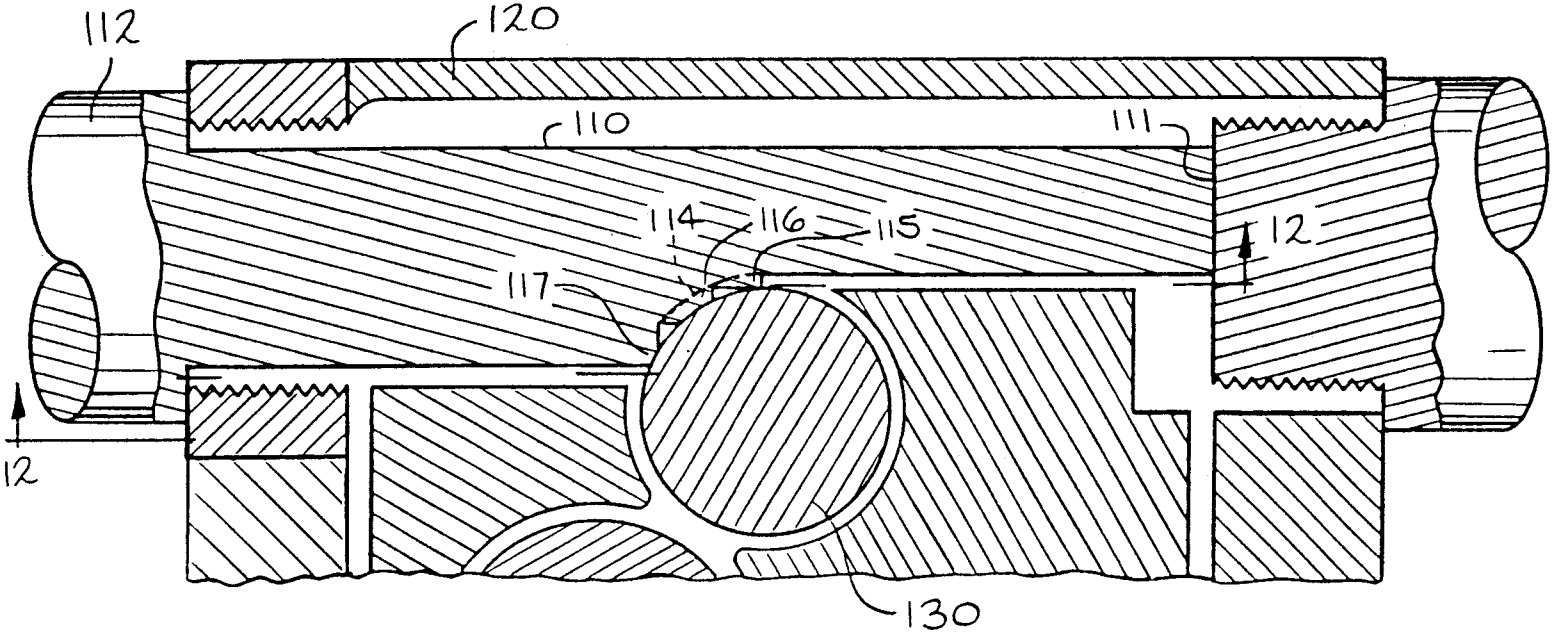
FIG. 13 is a fragmentary sectional view showing a portion of the mold for forming selected portions of the mixing valve.
Figure 14:
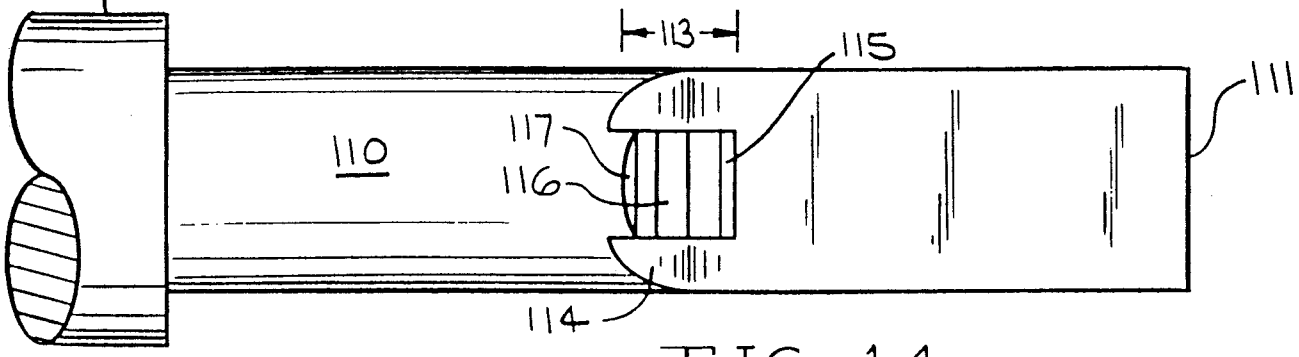
FIG. 14 is a view of the core pin portion of the mold of FIG. 11 as viewed along line 14—14 of FIG. 13.

Integrally molded with the lateral conduit 23 is a cylindrical housing 30 for a plunger type valve. The cylindrical housing includes an interior wall 39 having a cylindrical configuration. A group of rectangular inlet openings 32*a*, 32*b* and 32*c* formed in a portion of the cylindrical housing 30 provides communication between the passageway 24 and the interior of the cylindrical housing 30. The feature of the design of the passageway 24 having a semi-circular cross-section configuration in the area between the inlet coupling 20 and the cylindrical housing 30 and a circular cross-sectional configuration in the area between the cylindrical housing 30 and the outlet coupling 25 is utilized for purposes of molding the housing rather than the function of the valve. Thus, from the standpoint of functioning of the valve, the passageway 24 could have a substantially uniform cylindrical cross-sectional configuration throughout its entire length. However, the feature of the semi-circular configuration to provide a flat-walled section 23*a* in the area adjacent the inlet coupling 20 permits an elongated core pin having such configuration to be utilized to mold the entire interior wall of the passageway 24. More importantly, it permits the rectangular inlet openings 32*a*, 32*b*, and 32*c* to be formed during the molding operation, thus eliminating the necessity of a separate operation to cut the openings 32*a*, 32*b* and 32*c*. This feature is shown in FIGS. 13 and 14, where there is provided a core pin 110 extending between a free end 111 and a supported end 112. The core pin 110 is introduced into a mold 120 and forms the inner surface defining the passageway 24 of the lateral conduit 23. The portion of the core pin 110 from the free end 111 to a centrally located transition area 113 has a semicircular cross-sectional configuration while the portion between the transition area 113 and the supported end 112 has a circular cross-sectional configuration. As is customary in the injection molding art, a slight taper is provided in each of these sections, with a smaller size toward the free end, in order to facilitate removal of the core pin 110 from the mold following molding. In the transition area 113, there is provided an arcuate segment 114 conforming to the exterior wall of the cylindrical housing 30.

There is also provided a second core pin 130 for forming the interior surface of the cylindrical housing 30. When assembled for molding, the major portion of the arcuate segment 114 is spaced from the second core pin and defines a cavity in which the adjacent portion of the wall of the cylindrical housing 30 is formed. Extending from the surface of a central portion of the arcuate segment 114 are three protrusions 115, 116 and 117 each of which abuts the surface of mandrel 130 during the molding operation to form the openings 32*a*, 32*b* and 32*c*, respectively. As may be seen in FIG. 13, the ends of the protrusions 115, 116 and 117 contacting the mandrel 130 are curved to mate snugly against the mandrel 130. As will be appreciated by those skilled in the plastic molding field, during the molding operation, plastic material will flow into the areas between the respective sets of notches 115, 116 and 116, 117 to form the strips between the openings 32*a*, 32*b* and 32*c*.

The cylindrical housing 30 extends in an axial direction from an upper open end 33 lying in the plane defined by the upper edge 17 of the housing 10 to a lower end having an end panel 34 lying in the plane defined by the lower edge 16. The end panel 34 has an aperture 35 formed therein. Formed in the side of the cylindrical housing 30 180° from passageway 24 is an outlet opening 36 leading to an outlet passageway 37 of an outlet conduit 38 extending from such side. In the axial direction, the lowermost portion of the outlet opening 36 is slightly above the uppermost portions of the inlet openings 32*a*, 32*b* and 32*c*.

Figure 3:
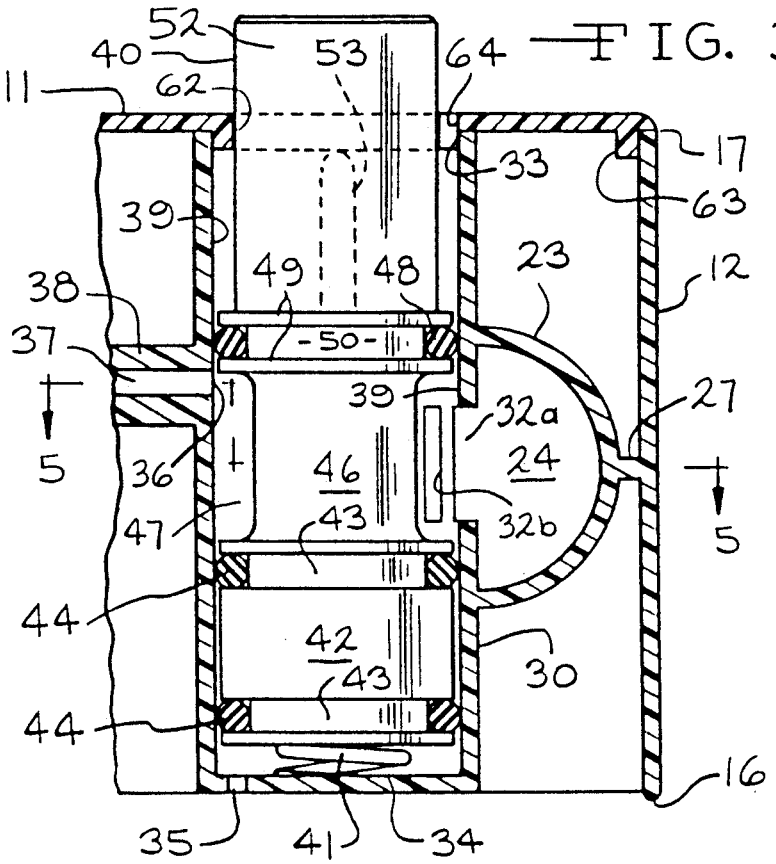
FIG. 3 is a sectional view taken through line 3—3 of FIG. 2 showing the water inlet valve in an open position.
Figure 4:
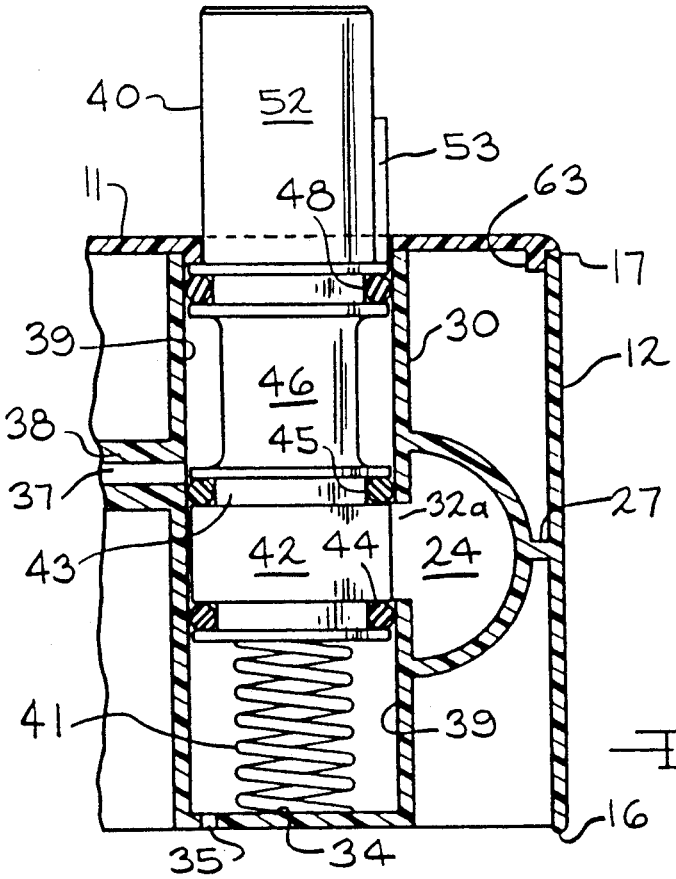
FIG. 4 is a view taken similar to FIG. 3 showing the water inlet valve in a closed position.
Figure 5:
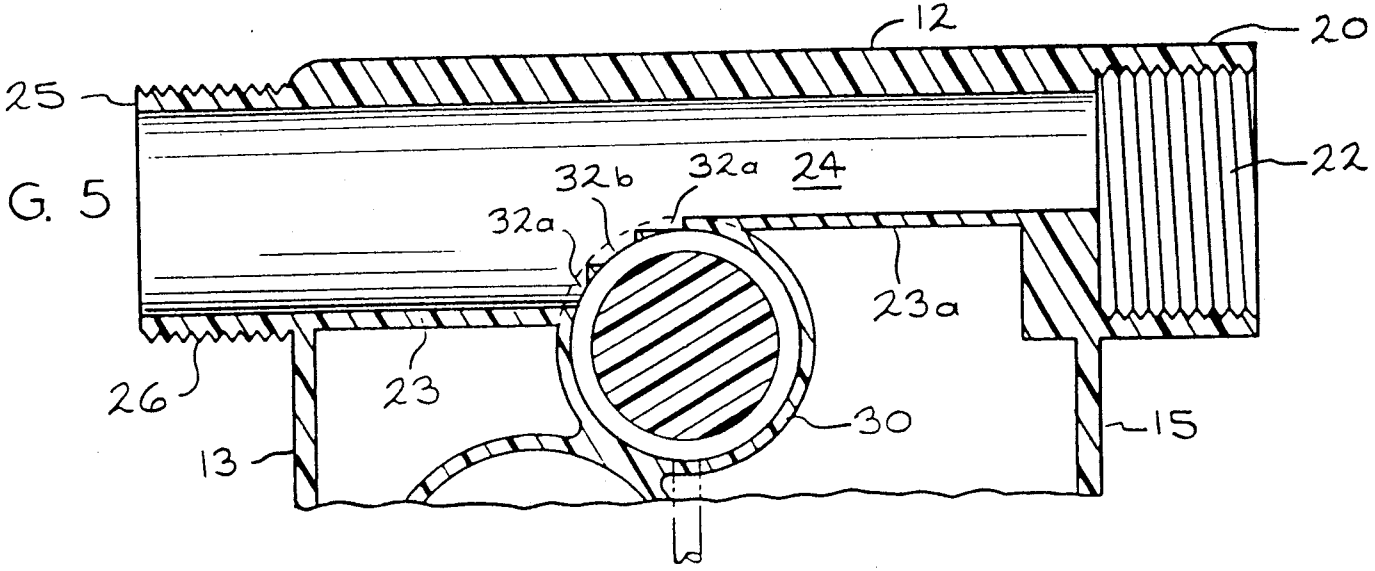
FIG. 5 is a sectional view taken through line 5—5 of FIG. 3.

Positioned within the cylindrical housing 30 is a spool-type plunger valve 40 and a spring 41 which is positioned between the plunger valve 40 and the end panel 34. The plunger valve is axially moveable within the cylindrical housing between an open position shown in FIG. 3 and a closed position as shown in FIG. 4. As such it is provided with a lower cylindrical segment 42 with annular grooves 43 at opposite ends thereof. Positioned within each of the annular grooves 43 is an annular rubber gasket 44 each of which is sealingly engaged to the interior wall 39 of the housing. The axial extent of the lower cylindrical segment 42 is such that when the plunger 40 is in the closed position shown in FIG. 4, the respective rubber gaskets 44 will span the upper and lower extent of the openings 32*a*, 32*b* and 32*c* but the upper of such gaskets 44 will be below the outlet opening 36. Immediately above the lower cylindrical segment 42 is a spindle 46, the major portion of which has a cylindrical configuration of reduced diameter from that of the interior wall 39. Thus, there is provided an annular gap 47 between the side wall of the spindle 46 and the interior wall 39 through which water may flow when the spindle 46 is aligned with both the openings 32*a*, 32*b* and 32*c* and the outlet passageway 37.

Immediately above the spindle 46 is a third annular rubber seal 48 held in position by a pair of enlarged collars 49 which define a groove 50 in which the rubber seal 48 is positioned.

As can be seen from FIG. 3, the axial extent of the spindle 46 is such that when the plunger 40 is in an open position, with its annular rubber seal 48 positioned above the outlet opening 36, the upper one of the other annular rubber gaskets 44 will be below the lower extent of the openings 32*a*, 32*b*, and 32*c*. The plunger valve 40 terminates in an cylindrical extension 52 which extends axially from the upper collar 49 to a point above the plane defined by the open end 33 of the cylindrical housing 30 and the upper end 17. Extending radially outwardly from the wall of the cylindrical extension 52 is projection 53 whose function is to retain the plunger valve 40 in a depressed position as shown in FIG. 3 when it is desired to have the plunge valve 40 open. This will become clearer following a description of the lid.

The lid 11 engages the housing 10 at the upper edge 17 of the side walls 12, 13, 14 and 15. If desired, the lid 11 may be provided with a peripheral flange 63 sized to contact the upper interior surfaces of the respective side walls 12, 13, 14 and 15. Extending downwardly from the inner surface of the lid 11 are a pair of sleeves 65 adapted to receive screws 55 for retaining the lid 11 on the housing 10.

The lid 11 has an aperture 61 from which extends a downwardly extending flange 62 sized to be snugly received within the open upper end 33 of the cylindrical housing 30. The aperture 61 is provided with a notch 64 sized to permit the projection 53 pass therethrough when the plunger valve 40 is moved from a raised closed position shown in FIG. 4 to a lowered open position shown in FIG. 3. Thus, when it is desired to open the communication between the passageway 24 and the outlet passageway 37, the plunger valve 40 is urged downwardly from the position shown in FIG. 4 to the position shown in FIG. 3 and is then rotated so that the projection 53 is no longer aligned with the notch 64 of faceplate 60. With the projection 53 out of alignment with the notch 64 of the lid 11, the plunger valve 40 will be retained in its lowered open position. When it is desired to open the plunger valve 40, it is simply rotated to a position such that the projection 53 is aligned with the notch 64. The spring 41 will then urge the plunger 40 upwardly to the position shown in FIG. 3, with the upper one of the enlarged collars 49 engaging the flange 62.

Referring now to FIGS. 1, 2 and 6—8 there is provided means for introducing and metering the flow of second liquid intended to be mixed with water or other primary liquid introduced through the outlet passageway 37. Such means includes a metering valve housing 70 integrally formed with other portions of the housing 10 including the cylindrical housing 30 which has a common wall portion 71.

The positioning of the metering valve housing 70 is such that the outlet conduit 38 extending from the cylindrical housing 30 has one side joined thereto. The portion of the outlet passageway 37 extending from the cylindrical housing 30 has a relatively small diameter. As the outlet passageway 37 extends to a position adjacent the metering valve housing 70, it flares outwardly in an outwardly flaring segment 37*a* and then to a larger cylindrical segment 37*b*. The outwardly flaring segment 37*a* flares outwardly at an angle of approximately 15° from the longitudinal axis (i.e., an included angle of 30°); however, this angle could be as great as 45° (included angle of 90°) or as small as 10° (included angle of 20°). The outwardly flaring portion 37*a* of the outlet passageway has an aperture 75 formed therein which communicates with the interior of the metering valve housing 70.

The outlet conduit 38 and the cylindrical segment 37*b* of the passageway 37 extend to the wall 14 of the housing 10. An outlet coupling 73 having an outlet passageway 74 aligned with the enlarged cylindrical segment 37*b* of passageway 37 may be fastened to the side wall 14.

As may be seen particularly in FIG. 2, the housing 10 and the lateral conduit 23, the cylindrical housing 30, the outlet conduit 38 and the metering valve housing 30 are integrally formed as one unit. In order to facilitate molding as an integral unit, there is provided a wall 72 extending upwardly from the bottom wall 18 to the outlet conduit 38.

The interior of the metering valve housing 70 includes a chamber 76 for receiving liquid concentrate and a concentrate inlet conduit 77 extending to the wall 14. A concentrate inlet nozzle 78 may be fastened to the wall 14 in communication with the concentrate inlet conduit 77. The chamber 76 for the liquid concentrate is defined by the arcuate side wall of the metering valve housing 70 at its periphery and a stepped web 79 having a first portion 79*a* in a plane immediately below that of the concentrate inlet passageway 77 and a second portion 79*b* in a plane immediately below that of the aperture 75 opening into the flared out portion 37*a* of the passageway 37. The portions 79*a* and 79*b* are joined by a wall portion 79*c* normal thereto. The second portion 79*b* of the web 79 has an aperture 80. At the upper end of the chamber 76 is provided a radial ledge 81 lying in the same plane as the upper surface of the second portion 79*b* of the web 79.

An umbrella check valve 83 is positioned within the metering valve housing 70. The umbrella check valve 83 includes a stem 84 which has an enlarged bulbed portion 84*a* and an umbrella portion 85 extending radially outwardly from the top of the stem 84. The umbrella check valve 83 is made of rubber or other resilient compressible material and is positioned with the stem 84 extending through the aperture 80. The outer periphery 86 of the umbrella portion 85 has a circular configuration and rests upon the second portion 79*b* of the stepped web 79 and, in those areas aligned with the first portion 79*a* on the radial ledge 81.

Figure 6:
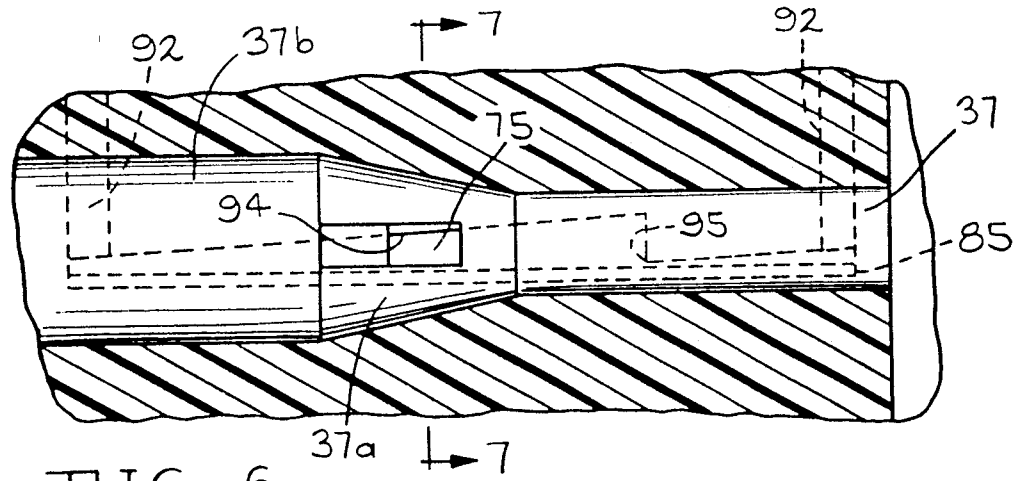
FIG. 6 is a sectional view taken through line 6—6 of FIG. 1.
Figure 7:
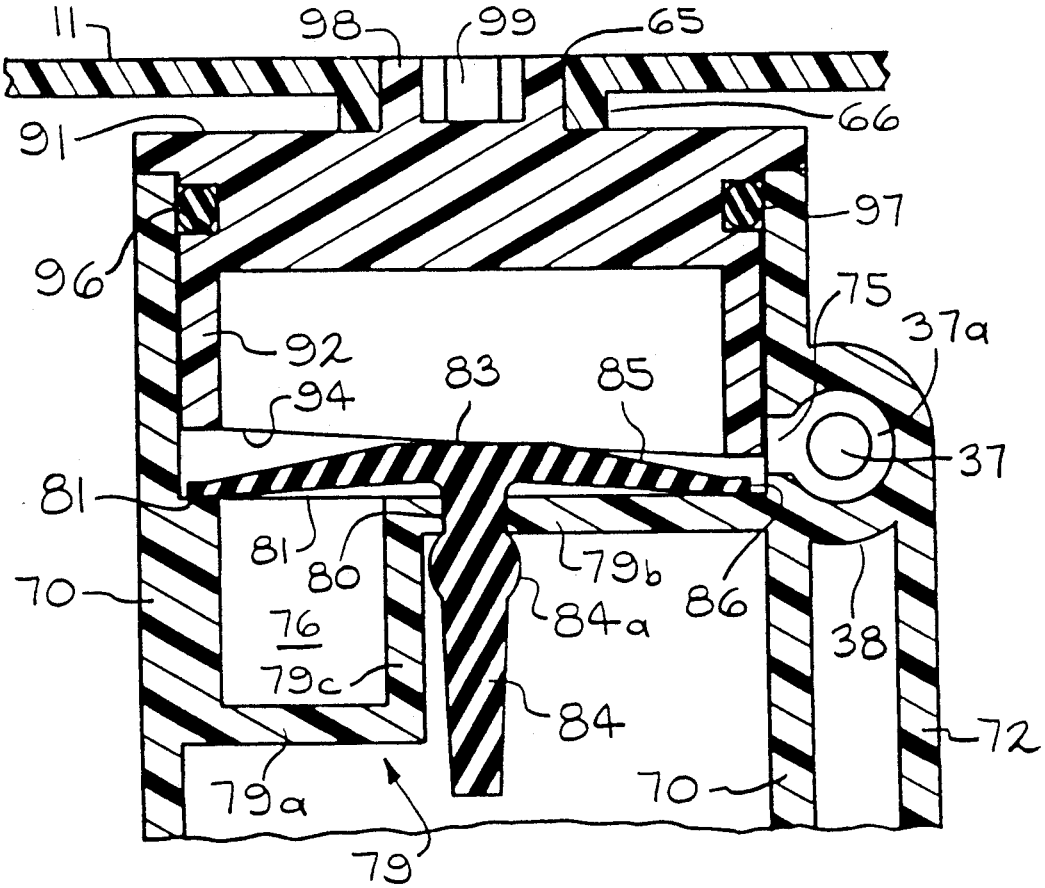
FIG. 7 is a sectional view taken through line 7—7 of FIG. 6 showing the inlet valve for metering the liquid concentrate in a partially open position.
Figure 8:
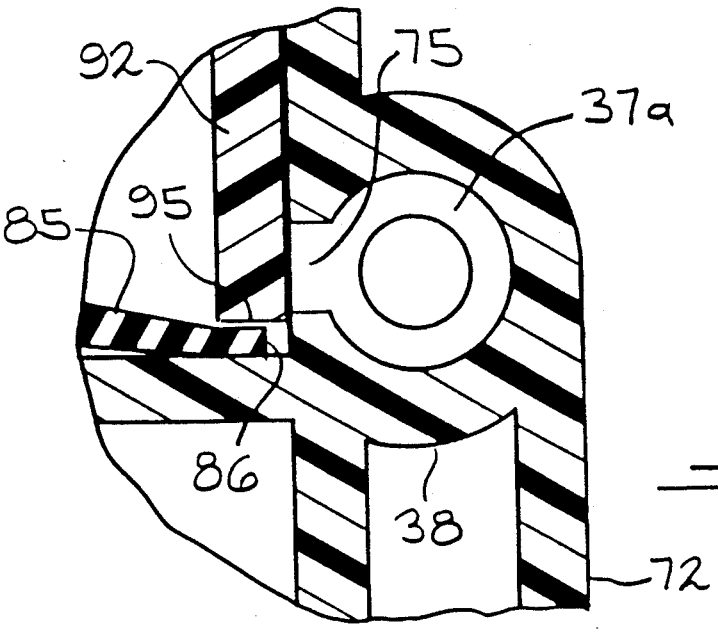
FIG. 8 is an enlarged fragmentary view of the inlet valve of FIG. 7 showing the valve for metering the liquid concentrate rotated to a fully closed position.

As will be appreciated from viewing FIGS. 2, 6 and 7, liquid concentrate entering the concentrate inlet 77 will be directed to the chamber 76 and, when the chamber is filled, will force the outer periphery 86 of the umbrella 85 upwardly and out of engagement with the upper portion 79*b* of the stepped web 79 and the ledge 81 thus permitting such concentrate to enter through the aperture 75 and into the outwardly flaring portion 37*a* of the outlet passageway 37 carrying the water or other primary liquid. The venturi effect resulting from the passageway 37 flaring outwardly in the segment 37*a* will tend to draw the concentrate liquid through the aperture 75. The water or other primary liquid is prevented from flowing back through the aperture 75 and into the chamber 76 by the umbrella 85 of the umbrella check valve 83.

An adjuster 90 is provided to regulate the amount of liquid concentrate which may flow from the chamber 76 through the aperture 75 and into the outwardly flaring portion 37*a* of the outlet passageway 37. The adjuster 90 includes a top panel portion 91 and a downwardly extending cylindrical skirt 92 which is sized to have its outer surface snugly engaged to the inner surface of the upper portion of the metering valve housing 70. The adjuster 90 is provided with an annular groove 96 and a rubber O-ring 97 which sealingly engages the inner surface of the metering valve housing 70. The adjuster 90 is held in position by the lid 11.

The adjuster 90 may be rotated within the metering valve housing 70. The skirt 92 of the adjuster 90 terminates at a lower edge 94 which follows a helical configuration and, as may be seen from viewing FIGS. 7 and 8, extends at its lowest point 95 to completely cover the aperture 75 when the adjuster is rotated to align such lowest point 95 and adjacent portions of the skirt 92 with the aperture 75. Such alignment serves to completely shut off the flow of liquid concentrate into the aperture 75 and outwardly flaring portion 37*a*.

As will be apparent from the drawings, as the adjuster 90 is rotated in a clockwise direction, the portion of the lower edge 94 aligned with the aperture 75 will, due to its spiral configuration progressively move upwardly relative thereto thus providing an increasingly large opening for the liquid concentrate to move therethrough. When the adjuster 90 is rotated to a position permiting maximum flow of liquid concentrate through the aperture 75, the portion of the lower edge 94 of the skirt 92 rotationally aligned with the aperture 75 will be positioned above such aperture so that such liquid may flow unimpeded through the aperture 75.

The adjuster 90 has a knob 98 with a hexagonal shape recess 90 extending upwardly from the top panel 91. The hexagonal recess is sized to receive an allen wrench which may be used for rotatably turning the adjuster 90.

The adjuster 90 is held in position within the upper portion of the cylindrical housing by means of the lid 11 for receiving the knob 98. The lid has an aperture 65 and a cylindrical flange 66 extending downwardly therefrom. The lid 11 also provided with a window 67 which is aligned with calibration numbers marked on the top panel 91 in order to accurately control the opening and closing of the aperture 75.

As shown in FIG. 1, there is also provided an integrally formed connecting flange 101 extending from the lower edge of the side wall 14 of the housing. A similar connecting flange (not shown) extends from the opposite corner of side wall 12. Such connecting flanges 101 permit the housing to be rigidly mounted to a supporting structure. Obviously, additional connecting flanges may be positioned in other areas.

In operation, water or other primary liquid medium is introduced into the housing 10 through the inlet opening 22, moves through the passageway 24 and into the cylindrical housing 30 through the opening 32*a*, 32*b* and 32*c*. This will be true irrespective of whether the outlet coupling 25 is connected in series to a second housing or is sealed off with a cap.

Assuming the plunger 40 is in the lowered open position as shown in FIG. 3, the water will flow through the openings 32*a*, 32*b* and 32*c*, around the spindle 46 and into the outlet passageway 37. It will continue through the outlet passageway 37 into the outwardly flared portion 37*a* thereof at which point the liquid concentrate introduced into the inlet passageway 77 through the chamber 76 and past the umbrella check valve 83 will be joined therewith through aperture 75. The amount or concentration of the second liquid may be varied by varying the effective opening of the aperture 75 upon rotation of the adjuster 90.

Figure 9:
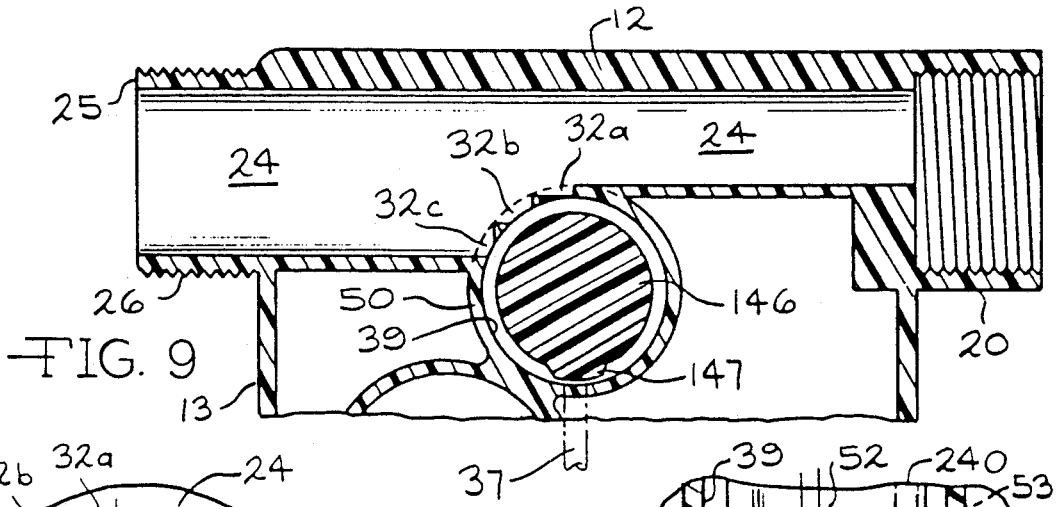
FIG. 9 is a view similar to FIG. 5 showing a modified water inlet valve.
Figure 10:
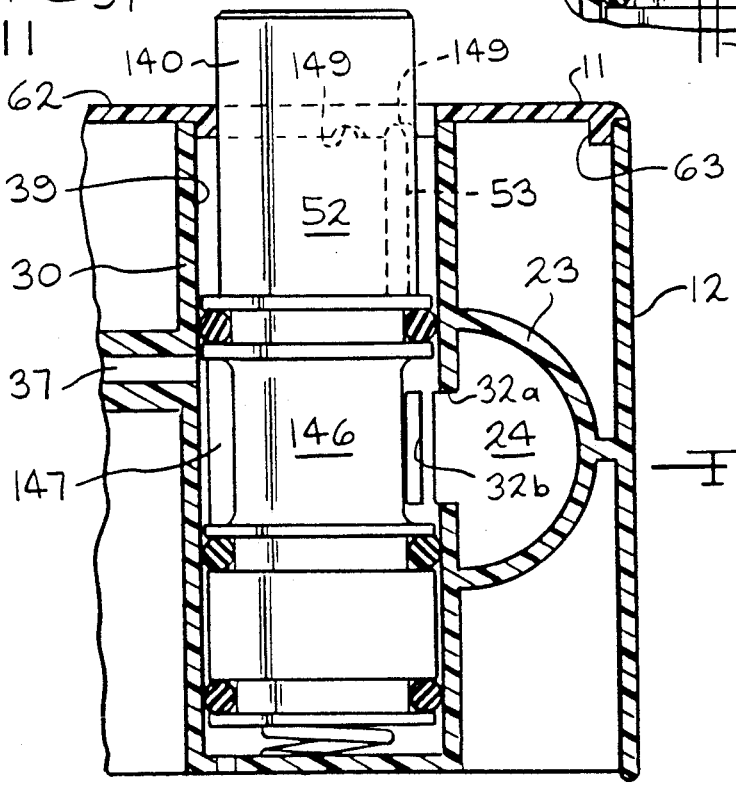
FIG. 10 is a view similar to FIG. 4 showing the modified water inlet valve.

Referring to FIGS. 9 and 10, there is shown a modified plunger valve 140 which has the capability of varying the flow of liquid from the passageway 24 to the outlet passageway 37. The modified plunger valve 140 has a spindle portion 146 which has on one side a protrusion 147 extending radially outwardly for its full axial height. All other portions of the modified plunger valve 140 are the same as the corresponding portions of the first plunger valve 40. The protrusion 147 is significantly closer to the interior wall 39 of the cylindrical housing 30 than the other portions of the spindle 146. Accordingly, when the plunger valve 140 is rotated to a position in which the protrusion 147 is aligned with the outlet passageway 37, the flow of liquid to the outlet passageway 37 will be restricted from the flow when the protrusion is out of alignment with such passageway 37. In this embodiment, the lid 11 is slightly modified by forming one or more indentations 149 in the annular flange 62 around the aperture 61 of the lid 11. The top of the projection 53 will fit into one of the indentations 149 depending upon the rotational alignment of the plunger valve 140. Appropriate markings may be placed on the lid 11 to let the operator know the rotational position of the protrusion 147 in relationship to the outlet passageway.

Figure 11:
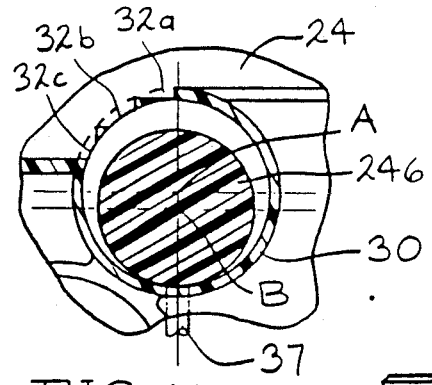
FIG. 11 is a fragmentary view similar to FIG. 9 showing yet another modified water inlet valve.
Figure 12:
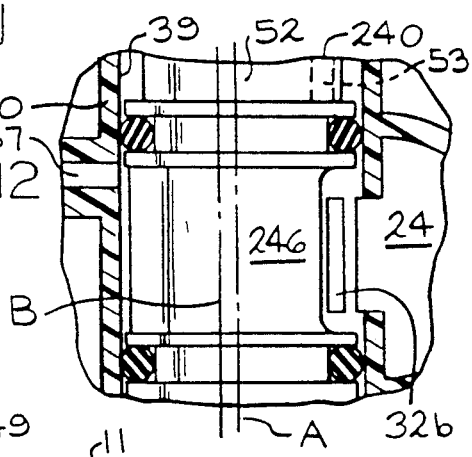
FIG. 12 is a view similar to FIG. 10 showing the modified water inlet valve of FIG. 11.

FIGS. 11 and 12 show yet another embodiment, for varying the flow of liquid from the passageway 24 to the outlet passageway 37. In this embodiment there is provided a plunger valve 240 having a spindle 246 formed without any protrusion such as the protrusion 147 of the embodiment shown in FIGS. 9 and 10. Under this embodiment, all portions of the plunger valve 240 other than the spindle have a longitudinal axis A which is the same as the longitudinal axis of the cylindrical housing 30. In contrast, the spindle 246 is formed with its longitudinal axis B offset from the longitudinal axis A. Preferably, the spindle 246 has a circular cross-sectional configuration; however, other cross-sectional configurations such as elongated or ellipitcal are also suitable. This embodiment has the further advantage of permitting an infinite number of variations of flow of liquid reaching the outlet passageway 37 between the minimum flow when the plunger valve 240 is rotated to provide the smallest spacing between the spindle and the outlet passageway and the maximum flow when it is rotated to provide the largest spacing.

Figure 15:
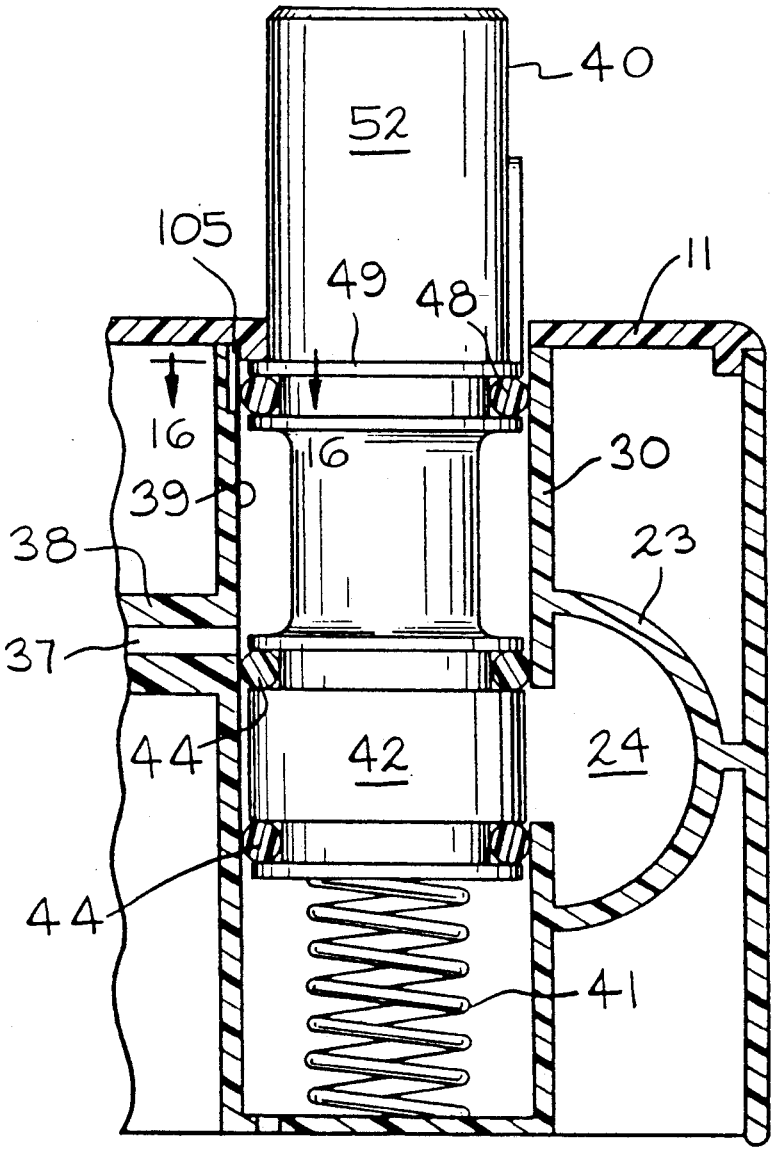
FIG. 15 is a view similar to FIG. 4 showing a modified embodiment.
Figure 16:
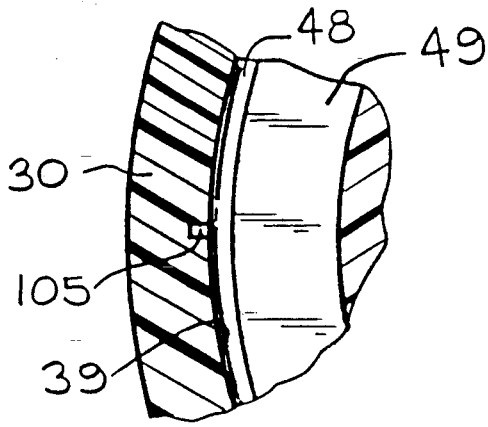
FIG. 16 is a fragmentary sectional view taken through line 16—16 of FIG. 15.

Referring now to FIGS. 15 and 16, there is provided means for preventing a negative pressure buildup or vacuum in the outlet passageway 37 when the plunger valve 40 is closed to prevent the flow of liquid from the passageway 24 to such outlet passageway 37. Such means consists of a longitudinally extending groove 105 formed in the interior wall 39 of the cylindrical housing 30 in an area adjacent the lid 11. The groove 105 extends below the upper portion of the interior wall 39, a distance such that it is just below the center of the upper annular seal 48 of the plunger valve 40 when the valve is closed. Thus, when the plunger valve 40 is in its upper most position with the annular rubber gaskets 44 closing off the flow of liquid to the passageway 37, the groove 105 will permit the chamber of the cylindrical housing 30 and the passageway 37 to be vented to atmosphere, thereby preventing the buildup of a negative pressure or vacuum which might otherwise cause liquid in the passageway 37 to be siphoned into the cylindrical housing 30.

The present invention provides a very effective and yet economical mechanism for combining two liquids in varying proportions. It further has the advantage of permitting a number of different concentrates to be mixed with a single source of water or other major liquid simply by joining a number of housings together.

I claim:

1. A valve for mixing two liquids in specific proportions comprising:

(a) a first chamber;

(b) a first inlet means for introducing a first liquid into said first chamber;

(c) an outlet passageway for receiving liquid from said first chamber, said outlet passageway having a plurality of sections including a first section of predetermined size adjacent the first chamber, a second section extending from and flaring outwardly from said first section to a size larger than said predetermined size;

(d) means for controlling the flow of said first liquid from said first chamber to said outlet passageway;

(e) means for venting said outlet passageway when the means for controlling the flow of said first liquid from said first chamber to said outlet passageway is positioned to prevent such flow;

(f) a second chamber;

(g) a second inlet means for introducing a second liquid into said second chamber;

(h) an opening communicating between said second chamber and said outwardly flaring second section;

(i) means for controlling the flow of said second liquid from said second chamber to said outwardly flaring second section; and (j) an outlet communicating with the outwardly flaring second section for discharging the mixed first and second liquids.

2. A valve for mixing two liquids in specific proportions comprising:

(a) a first chamber having a cylindrical inner wall;

(b) a first inlet means for introducing a first liquid into said first chamber;

(c) an outlet passageway for receiving liquid from said first chamber, said outlet passageway having a plurality of sections including a first section of predetermined size adjacent the first chamber, a second section extending from and flaring outwardly from said first section to a size larger than said predetermined size, said first inlet means and said outlet passageway opening into said chamber in axially spaced relationship to each other, (d) means for controlling the flow of said first liquid from said first chamber to said outlet passageway, said means for controlling the flow of first liquid to said outlet passageway including a plunger valve positioned for movement axially within said chamber, said plunger valve having a first section with upper and lower gasket means engaging said inner wall and a second section above said upper gasket means having a major portion in spaced relationship to said inner wall and an annular seal above said major portion engaging said inner wall, said plunger valve permitting flow of said first liquid from said first inlet means to said outlet passageway when the major portion of said second section is aligned with both said first inlet means and said outlet passageway and preventing such flow when the plunger valve is positioned with said first inlet means aligned between said upper and lower gasket means;

(e) a second chamber;

(f) a second inlet means for introducing a second liquid into said second chamber;

(g) an opening communicating between said second chamber and said outwardly flaring second section;

(h) means for controlling the flow of said second liquid from said second chamber to said outwardly flaring second section; and, (i) an outlet communicating with the outwardly flaring second section for discharging the mixed first and second liquids.

3. A valve according to claim 2, wherein said plunger valve second section major portion is spaced closer to said cylindrical inner wall in one circumferential area than other circumferential areas and said plunger valve second section is rotatable from a position in which said one circumferential area is aligned with said outlet passageway to positions out of such alignment.

4. A valve according to claim 3, wherein said valve second section major portion has a circular cross-sectional configuration the center of which is offset from the longitudinal axis of said cylindrical inner wall.

5. A valve according to claim 3, wherein said one circumferential area of the plunger valve second section major portion comprises an axially extending protrusion which is closer to said cylindrical inner wall than other circumferential portions of said second section major portion.

6. A valve according to claim 1, further including a housing having wall means encircling said first and second chambers and wherein said first inlet means includes a conduit defining a passageway extending from an inlet opening at said wall means to said first inlet means.

7. A valve according to claim 6, wherein said first chamber has a wall which includes a section of a cylinder and has a cylindrical inner wall surface having a longitudinal axis and wherein said conduit engages said cylindrical wall section tangentially.

8. A valve according to claim 7, wherein said conduit extends beyond said cylindrical wall section to an outlet in said housing wall for discharging said first liquid, the portion of the conduit from said housing inlet opening to said cylindrical wall section having, in cross section, a planar segment tangetially joined to said cylindrical wall section and the portion of the conduit from the cylindrical wall section to said housing wall outlet having, in cross section, an arcuate segment joined to said cylindrical housing wall section, said first inlet means being located within the passageway of said conduit between said planar and said arcuate segments.

9. A valve according to claims 1, 2, 3, 4, 5, 6, 7, or 8, wherein said second chamber (a) is defined in part by a wall portion joined to the outwardly flaring second section of said outlet passageway at said opening and (b) has positioned therein valve means permitting the flow of said second liquid from said second chamber to said outwardly flaring second section while preventing the flow of liquid from said outlet passageway to said second chamber.

10. A valve according to claims 1, 2, 3, 4, 5, 6, 7, or 8, wherein said second chamber (a) is defined in part by a wall portion having a cylindrical inner surface, said wall portion joined to the outwardly flaring second section of said outlet passageway at said opening and (b) has positioned therein valve means having a skirt mounted in rotatable engagement with said cylindrical inner surface, and being rotatable from a restricted position in which said skirt at least partially blocks the flow of liquid through the opening between said second chamber and said outwardly flaring second section to a fully open position permitting increased flow of liquid through said opening.

11. A valve according to claims 1, 2, 3, 4, 5, 6, 7, or 8, wherein said second chamber (a) is defined in part by a wall portion having a cylindrical inner surface, said wall portion joined to the outwardly flaring second section of said outlet passageway at said opening and (b) has positioned therein valve means having a skirt positioned in rotatable engagement with said cylindrical inner surface, said skirt having a lower edge following a generally helical path, said skirt overlying the opening between said second chamber and said outwardly flaring second section by varying amounts depending upon the rotatable positioning thereof.

12. A valve according to claims 1, 2, 3, 4, 5, 6, 7, or 8, wherein said second chamber (a) is defined in part by a wall portion having a cylindrical inner surface, said wall portion joined to the outwardly flaring second section of said outlet passageway at said opening and (b) has positioned therein (i) first valve means permitting the flow of said second liquid from said second chamber to said outwardly flaring second section while preventing the flow of liquid from said outlet passageway to the inlet side thereof and (ii) second valve means having a skirt positioned in rotatable engagement with said cylindrical inner surface, said skirt having a lower edge following a generally helical path, said skirt overlying the opening between said second chamber and said outwardly flaring second section by varying amounts depending upon the rotatable positioning thereof.

13. A valve according to claim 2, further including a housing having wall means encirculing said first and second chambers and wherein said first inlet means includes a conduit defining a passageway extending from an inlet opening at said wall means to said first inlet means.

14. A valve according to claim 13, wherein said first chamber has a wall which includes a section of a cylinder and has a cylindrical inner wall surface having a longitudinal axis and wherein said conduit engages said cylindrical wall section tangentially.

15. A valve according to claim 14, wherein said conduit extends beyond said cylindrical wall section to an outlet in said housing wall for discharging said first liquid, the portion of the conduit from said housing inlet opening to said cylindrical wall section having, in cross section, a planar segment tangetially joined to said cylindrical wall section and the portion of the conduit from the cylindrical wall section to said housing wall outlet having, in cross section, an arcuate segment joined to said cylindrical housing wall section, said first inlet means being located within the passageway of said conduit between said planar and said arcuate segments.

16. A mixing valve comprising a housing, said housing having a first inlet and a first passageway for receiving a first liquid, a first valve having (a) a first valve inlet communicating with said first passageway, (b) a first valve outlet and (c) means for opening and closing communication between said valve inlet and valve outlet, vent means for venting said valve outlet when the means for opening and closing communication between said valve inlet and valve outlet is positioned to prevent such flow, a second passageway extending from said first valve outlet, said second passageway having first, second and third segments, said first segment having a cross section of predetermined size, said second segment flaring outwardly from said first segment to said third segment, said third segment having a cross-sectional size larger than said predetermined size, said second passageway having an aperture in said outwardly flaring second segment, said housing having a metering chamber and second inlet means for receiving a second liquid, means for directing said second liquid from said second inlet to said metering chamber, said metering chamber communicating with the aperture of said outwardly flaring second segment and valve means for regulating the flow of said second liquid through said metering chamber and into the aperture of said outwardly flaring second segment as the first liquid passes therethrough and outlet means for discharging the mixed first and second liquids.

17. A mixing valve comprising a housing, said housing having a first inlet and a first passageway for receiving a first liquid, a first valve having (a) a first valve inlet communicating with said first passageway, (b) a first valve outlet and (c) means for opening and closing communication between said valve inlet and valve outlet, a second passageway extending from said first valve outlet, said second passageway having first, second and third segments, said first segment having a cross section of predetermined size, said second segment flaring outwardly from said first segment to said third segment, said third segment having a cross-sectional size larger than said predetermined size, said second passageway having an aperture in said outwardly flaring second segment, said housing having a metering chamber and second inlet means for receiving a second liquid, means for directing said second liquid from said second inlet to said metering chamber, said metering chamber having a cylindrical inner wall communicating with the aperture of said outwardly flaring second segment and valve means for regulating the flow of said second liquid through said metering chamber and into the aperture of said outwardly flaring second segment as the first liquid passes therethrough, said valve means including plug means having a skirt with a cylindrical outer wall engaged to said cylindrical inner wall, said plug means being rotatable from (i) a position in which said cylindrical outer wall overlies said aperture to at least partially block the flow of said second liquid from said metering chamber to said outwardly flaring second section to (ii) other positions permitting increased flow, and outlet means for discharging the mixed first and second liquids.

18. A mixing valve according to claim 17, wherein the skirt of said plug means is longer in one circumferential area than in others.

19. A mixing valve according to claim 17, wherein the skirt of said plug means terminates in a free end having a helical configuration.

20. A mixing valve according to claim 17, 18 or 19 further including a check valve positioned in said metering chamber, said check valve permitting the flow of said second liquid from said second inlet to said aperture but preventing the flow of liquid in the reverse direction.

21. A mixing valve comprising a housing, said housing having a first inlet and a first passageway for receiving a first liquid, a first valve having (a) a first valve inlet communicating with said first passageway, (b) a first valve outlet and (c) means for opening and closing communication between said valve inlet and valve outlet, a second passageway extending from said first valve outlet, said second passageway having first, second and third segments, said first segment having a cross section of predetermined size, said second segment flaring outwardly from said first segment to said third segment, said third segment having a cross-sectional size larger than said predetermined size, said second passageway having an aperture in said outwardly flaring second segment, said housing having a metering chamber and second inlet means for receiving a second liquid, means for directing said second liquid from said second inlet to said metering chamber, said metering chamber having an inner wall communicating with the aperture of said outwardly flaring second segment and valve means for regulating the flow of said second liquid through said metering chamber and into the aperture of said outwardly flaring second segment as the first liquid passes therethrough said valve means including plug means having a skirt slidingly engaged to said inner wall in the area of said aperture, said plug means being slidingly moveable with respect to said inner wall from (a) a position which overlies said aperture to at least partially block the flow of said second liquid from said metering chamber to said outwardly flaring second section to (b) other positions permitting increased flow, and outlet means for discharging the mixed first and second liquids.

22. A valve for mixing two liquids in specific proportions comprising (a) a first chamber;

(b) a first inlet means for introducing a first liquid into said first chamber;

(c) an outlet passageway for receiving liquid from said first chamber, said outlet passageway having a plurality of sections, including a substantially cylindrical first section of predetermined diameter, a second section flaring outwardly from said first section and a third section extending to an outlet;

(d) a second chamber:

(e) a second inlet means for introducing a second liquid into said second chamber;

(f) an opening in said outwardly flaring section providing communication between said second chamber and said outwardly flaring second section; and, (g) means for varying the size of said opening to control the amount of said second liquid flowing from said second chamber to said outwardly flaring second section.

23. A valve for mixing two liquids in specific proportions comprising:

(a) a housing having wall means;

(b) a first chamber encircled by said wall means, said first chamber having a wall which includes a section of a cylinder and has a cylindrical inner wall surface having a longitudinal axis;

(c) a first inlet means for introducing a first liquid into said first chamber, said first inlet means including (i) a conduit defining a passageway extending from an inlet opening at said wall means to said first chamber wall, said conduit engaging said cylindrical wall section tangentially and (ii) aperture means in said cylindrical wall section in the area of tangential engagement;

(d) an outlet passageway for receiving liquid from said first chamber, said outlet passageway having a plurality of sections including a first section of predetermined size adjacent the first chamber, a second section extending from and flaring outwardly from said first section to a size larger than said predetermined size;

(e) means for controlling the flow of said first liquid from said first chamber to said outlet passageway;

(f) a second chamber;

(g) a second inlet means for introducing a second liquid into said second chamber;

(h) an opening communicating between said second chamber and said outwardly flaring second section;

(i) means for controlling the flow of said second liquid from said second chamber to said outwardly flaring second section; and, (j) an outlet communicating with the outwardly flaring second section for discharging the mixed first and second liquids.

24. A valve according to claim 23, wherein said second chamber (a) is defined in part by a wall portion joined to the outwardly flaring second section of said outlet passageway at said opening and (b) has positioned therein valve means permitting the flow of said second liquid from said second chamber to said outwardly flaring second section while preventing the flow of liquid from said outlet passageway to said second chamber.

25. A valve for mixing two liquids in specific proportions comprising:

(a) a housing having wall means;

(b) a first chamber encircled by said wall means, said first chamber having a wall which includes a section of a cylinder and has a cylindrical inner wall surface having a longitudinal axis;

(c) a first inlet means for introducing a first liquid into said first chamber, said first inlet means including a conduit defining a passageway extending from an inlet opening at said wall means to said first chamber wall, said conduit engaging said cylindrical wall section tangentially and extending beyond said cylindrical wall section to an outlet in said housing wall for discharging said first liquid, the portion of the conduit from said housing inlet opening to said cylindrical wall section having, in cross section, a planar segment tangentially joined to said cylindrical wall section and the portion of the conduit from the cylindrical wall section to said housing wall outlet having, in cross section, an arcuate segment joined to said cylindrical housing wall section, said first inlet means being located within the passageway of said conduit between said planar and said arcuate segments;

(d) an outlet passageway for receiving liquid from said first chamber, said outlet passageway having a plurality of sections including a first section of predetermined size adjacent the first chamber, a second section extending from and flaring outwardly from said first section to a size larger than said predetermined size;

(e) means for controlling the flow of said first liquid from said first chamber to said outlet passageway;

(f) a second chamber;

(g) a second inlet means for introducing a second liquid into said second chamber;

(h) an opening communicating between said second chamber and said outwardly flaring second section;

(i) means for controlling the flow of said second liquid from said second chamber to said outwardly flaring second section; and, (j) an outlet communicating with the outwardly flaring second section for discharging the mixed first and second liquids.

26. A valve for mixing two liquids in specific proportions comprising:

(a) a housing having wall means;

(b) a first chamber encircled by said wall means, said first chamber having a wall which includes a section of a cylinder and has a cylindrical inner wall surface having a longitudinal axis;

(c) a first inlet means for introducing a first liquid into said first chamber, said first inlet means including a conduit defining a passageway extending from an inlet opening at said wall means to said first chamber wall, said conduit engaging said cylindrical wall section tangentially;

(d) an outlet passageway for receiving liquid from said first chamber, said outlet passageway having a plurality of sections including a first section of predetermined size adjacent the first chamber, a second section extending from and flaring outwardly from said first section to a size larger than said predetermined size;

(e) means for controlling the flow of said first liquid from said first chamber to said outlet passageway;

(f) a second chamber which (i) is defined in part by a wall portion having a cylindrical inner surface, said wall portion joined to the outwardly flaring second section of said outlet passageway at said opening and (ii) has positioned therein valve means having a skirt mounted in rotatable engagement with said cylindrical inner surface, and being rotatable from a restricted position in which said skirt at least partially blocks the flow of liquid through the opening between said second chamber and said outwardly flaring second section to a fully open position permitting increased flow of liquid through said opening;

(g) a second inlet means for introducing a second liquid into said second chamber;

(h) an opening communicating between said second chamber and said outwardly flaring second section;

(i) means for controlling the flow of said second liquid from said second chamber to said outwardly flaring second section; and, (j) an outlet communicating with the outwardly flaring second section for discharging the mixed first and second liquids.

27. A valve according to claim 26, wherein said skirt has a lower edge following a generally helical path, said skirt overlying the opening between said second chamber and said outwardly flaring second section by varying amounts depending upon the rotatable positioning thereof.

28. A valve according to claim 26, wherein said second chamber has positioned therein additional valve means permitting the flow of said second liquid from said second chamber to said outwardly flaring second section while preventing the flow of liquid from said outlet passageway to the inlet side thereof.

29. A valve for mixing two liquids in specific proportions comprising:

(a) a first chamber;

(b) a first inlet means for introducing a first liquid into said first chamber;

(c) an outlet passageway for receiving liquid from said first chamber, said outlet passageway having a plurality of sections including a first section of predetermined size adjacent the first chamber, a second section extending from and flaring outwardly from said first section to a size larger than said predetermined size, said outwardly flaring second section having an opening;

(d) means for controlling the flow of said first liquid from said first chamber to said outlet passageway;

(e) a second chamber, said second chamber (i) being defined in part by a wall portion joined to the outwardly flaring second section of said outlet passageway at said opening and (ii) having positioned therein valve means permitting the flow of said second liquid from said second chamber to said outwardly flaring second section while preventing the flow of liquid from said outlet passageway to said second chamber, said second chamber wall portion having a cylindrical inner surface and further including an adjuster having a skirt mounted in rotatable engagement with said cylindrical inner surface from a restricted position in which said skirt at least partially blocks the flow of liquid through the opening between said second chamber and said outwardly flaring second section to a fully open position permitting increased flow of liquid through said opening;

(f) a second inlet means for introducing a second liquid into said second chamber; and (g) an outlet communicating with the outwardly flaring second section for discharging the mixed first and second liquids.

30. A valve according to claim 29, wherein said skirt has a lower edge following a generally helical path, said skirt overlying the opening between said second chamber and said outwardly flaring second section by varying amounts depending upon the rotatable positioning thereof.

31. A valve for mixing two liquids in specific proportions comprising:

(a) a first chamber;

(b) a first inlet means for introducing a first liquid into said first chamber;

(c) an outlet passageway for receiving liquid from said first chamber, said outlet passageway having a plurality of sections including a first section of predetermined size adjacent the first chamber, a second section extending from and flaring outwardly from said first section to a size larger than said predetermined size, said outwardly flaring second section having an opening;

(d) means for controlling the flow of said first liquid from said first chamber to said outlet passageway;

(e) a second chamber said second chamber (i) being defined in part by a wall portion having a cylindrical inner surface joined to the outwardly flaring second section of said outlet passageway at said opening and (ii) having positioned therein rotatable adjuster valve means, said rotatable adjuster valve means including a skirt mounted in rotatable engagement with said cylindrical inner surface for rotatable movement from a restricted position in which said skirt at least partially blocks the flow of liquid through the opening between said second chamber and said outwardly flaring second section to a fully open position permitting increased flow of liquid through said opening;

(f) a second inlet means for introducing a second liquid into said second chamber; and (g) an outlet communicating with said outwardly flaring second section for discharging the mixed first and second liquids.

32. A valve according to claim 31, wherein said skirt has a lower edge following a generally helical path, said skirt overlying the opening between said second chamber and said outwardly flaring second section by varying amounts depending upon the rotatable positioning thereof.

33. A valve according to claim 31, wherein said second chamber has positioned therein additional valve means permitting the flow of said second liquid from said second chamber to said outwardly flaring second section while preventing the flow of liquid from said outlet passageway to the inlet side thereof.

* * * * *